United States Patent [19]

McCoy

[11] Patent Number: 4,530,646

[45] Date of Patent: Jul. 23, 1985

[54] PUMP JACK OPERATED COMPRESSOR

[76] Inventor: Charles D. McCoy, 5101 N. Ave. "A", Apt. 270, Midland, Tex. 79701

[21] Appl. No.: 484,235

[22] Filed: Apr. 12, 1983

[51] Int. Cl.[3] ..... F04B 19/00; F04B 29/00

[52] U.S. Cl. ..... 417/464; 417/534

[58] Field of Search ..... 417/534, 536, 464; 74/589; 92/170

[56] References Cited

U.S. PATENT DOCUMENTS

| | | | |
|---|---|---|---|
| 2,259,020 | 10/1941 | Wineman | 74/589 |
| 2,459,334 | 1/1949 | Patterson et al. | 74/589 |
| 2,672,815 | 3/1954 | Eadie | 417/85 |
| 2,765,742 | 10/1956 | King | 417/536 |
| 2,871,072 | 1/1959 | Parks et al. | 74/589 |
| 2,877,652 | 3/1959 | Muschalek | 74/589 |
| 3,006,282 | 10/1961 | Sisson | 92/170 |
| 3,040,712 | 6/1962 | Harrah | 92/170 |
| 3,124,080 | 3/1964 | Sisson | 92/170 |
| 3,125,004 | 3/1964 | White | 92/170 |
| 3,391,645 | 7/1968 | Koza | 417/566 |
| 3,695,149 | 10/1972 | Eberhart | 92/170 |

*Primary Examiner*—William L. Freeh

*Attorney, Agent, or Firm*—Harvey B. Jacobson

[57] ABSTRACT

A compressor of the reciprocating piston and cylinder type especially adapted for use in moving gas from the wellhead or casing of a producing oil or gas well into the gas sales line with the compressor being operated by the conventional pump jack utilized to operate a downhole pump and more particularly the walking beam of the pump jack is used as the prime mover for operating the compressor. The compressor includes a long stroke piston reciprocal in a cylinder with the cylinder being attached to the walking beam and the piston rod supported from the pump jack skid or samson post with the attachment structures being unique to enable optimum operating conditions in each installation. The cylinder and piston are constructed of non-metallic components or coated to resist corrosion by various corrosive materials normally found in natural gas. The compressor may be a single acting arrangement in which the compression stroke occurs as the pump rods and downhole pump are descending in the well to use the force of gravity during the compression stroke to enable operation with less expenditure of mechanical energy. The compressor may also be double acting for larger volume capacity and is installed within the actual movement capabilities of the walking beam with adjustable mounting enabling maximum output of the compressor.

9 Claims, 6 Drawing Figures 60
58
18
52
66
64
56
68
40
10
34
38
44
3
3
46
98
99
92
42
50
96
91
94
36
48
70
72
76
74
78
84
4
4
84
80
89
88
82
90
14

104
42
38
44
46
102

80
84
86
78
82

PUMP JACK OPERATED COMPRESSOR

BACKGROUND OF THE INVENTION

1. Field of the Invention

The present invention generally relates to a gas compressor associated with a producing oil well having a downhole pump operated by a conventional pump jack with the compressor including a piston and cylinder arrangement in which the relative reciprocation between the piston and cylinder is obtained by connecting the piston and cylinder between the oscillating walking beam and a stationary point on the pump jack such as the skid or base or samson post with the compressor including novel structural components enabling it to efficiently move gas from the wellhead into a sales line or the like to reduce back pressure at the wellhead and reduce back pressure at the formation thereby enabling the formation to produce or flow oil and gas at its maximum rate in order to increase production of the well.

2. Discussion of Relevant Art

Reciprocating piston and cylinder type compressors have been employed for compressing various compresible fluids for many purposes. The following U.S. patents known to applicant relate to compressors or pumps some of which are related to oil well equipment: U.S. Pat. Nos. 2,672,815, 3-1954: 2,870,715, 1-1959: 3,016,833, 1-1962: 3,655,301, 4-1972: 3,986,355, 10-1976.

U.S. Pat. No. 3,655,301 discloses a pump or compressor associated with gas or oil well equipment in the form of a reciprocating piston and cylinder assembly connected between the walking beam and a stationary base of a pump jack for compressing gas at the well site.

SUMMARY OF THE INVENTION

An object of the present invention is to provide a compressor operated by a pump jack for removing gas from the wellhead, compressing it and discharging it into a sales line or other distribution arrangements including a cylinder having its upper end articulately connected to the walking beam of the pump jack and a piston and piston rod reciprocal in the cylinder with the lower end of the piston rod being articulately connected to the pump jack skid or base or the samson post with adjustment features incorporated into the mounting structure for the compressor to enable installation with various existing pump jacks and enabling maximum stroke capability for optimum volume of compressed gas for each stroke of the compressor.

Another object of the invention is to provide a compressor in accordance with the preceding object in which the cylinder and piston include non-corrosive materials in those components which come into contact with the natural gas being compressed in order to reduce the adverse effects of corrosive ingredients in the natural gas.

A further object of the invention is to provide a compressor in accordance with the preceding objects in which the cylinder includes removable end plates sealingly connected with the ends of the cylinder by external through bolts with the cylinder being constructed of glass fiber reinforced plastic with a liner of epoxy material and the piston also being constructed of a non-metallic resinous material to resist corrosive action of various corrosive agents found in natural gas.

Still another object of the invention is to provide a gas compressor in accordance with the preceding objects which is efficient in moving gas from the wellhead into the sales line and which can be easily and economically installed in association with a pump jack thereby enabling utilization of a prime mover which is already at the well site thereby eliminating the necessity of providing an additional prime mover for operating the compressor thereby enabling minimum cost of installation of the gas compressor.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
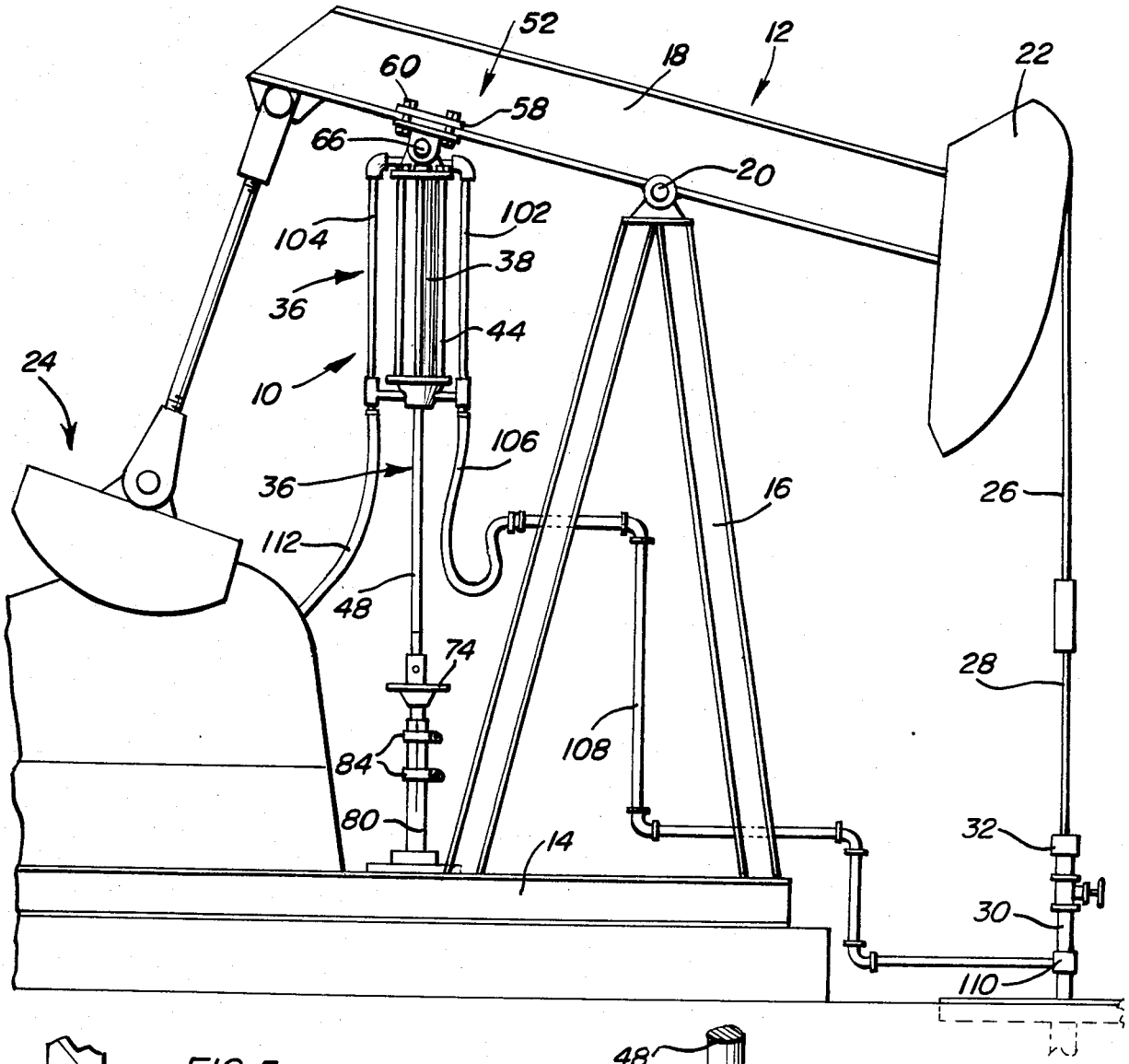
FIG. 1 is an elevational view illustrating the installation of the gas compressor of the present invention associated with a pump jack at a well site.

Referring now specifically to the drawings, the compressor of the present invention is designated by reference numeral 10 and in FIG. 1 is illustrated in association with a conventional pump jack 12 which includes the usual skid or base 14 on which a samson post 16 is supported and which extends upwardly therefrom for supporting a walking beam 18 from a trunnion 20 so that the walking beam 18 can oscillate about a horizontal axis. At one end of the walking beam 18, a horsehead 22 is attached and at the other end of the walking beam 18, a prime mover, eccentric, counterweight and connecting rod drive assembly 24 is connected in order to oscillate the beam 18 for operating a downhole pump (not shown). The horsehead 22 has the usual bridle assembly 26 connected thereto which is connected to the upper end of a polish rod 28 which extends into the wellhead or casing 30 through a stuffing box 32 in a well known and conventional manner with the polish rod 28 being connected with a pump rod or sucker rod extending to the downhole pump. The aforementioned structure with respect to the pump jack is entirely conventional and forms no particular part of the present invention except in the manner in which the compressor 10 is associated with the pump jack so that the compressor 10 utilizes the power from the prime mover which operates the walking beam to also operate the compressor 10.

Figure 2:
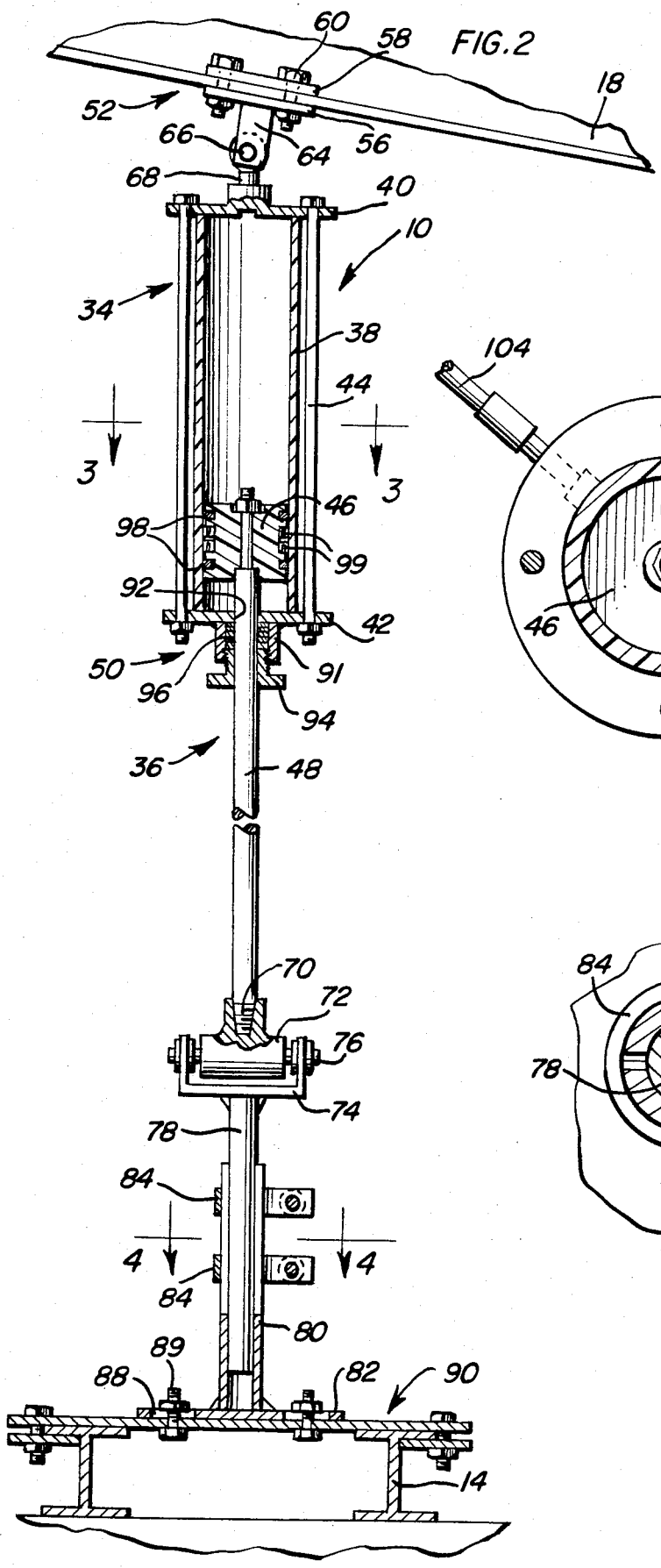
FIG. 2 is a vertical sectional view of the compressor illustrating the structural details thereof.
Figure 3:
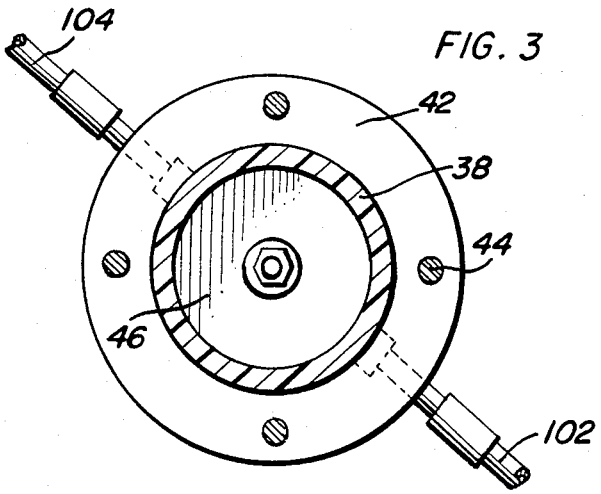
FIG. 3 is a transverse sectional view taken substantially upon a plane passing along section line 3—3 on FIG. 2 illustrating further structural details of the piston and cylinder assembly.
Figure 4:
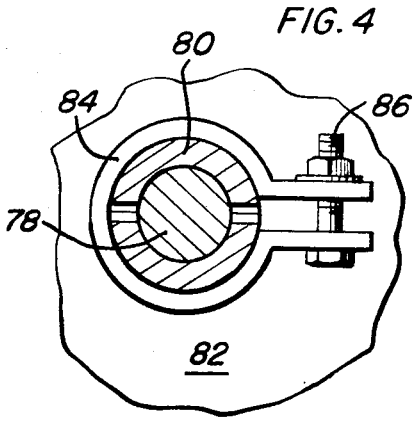
FIG. 4 is a transverse sectional view taken substantially upon a plane passing along section line 4—4 on FIG. 2 illustrating the adjustable support structure for the piston rod.

The compressor 10 includes a cylinder assembly 34 and a piston and piston rod assembly 36 as illustrated in FIG. 2. The cylinder assembly 34 includes an elongated cylinder 38 provided with an upper end plate 40 and a lower end plate 42 which are of circular configuration and of larger diameter than the cylinder 38. A plurality of elongated through bolts 44 extend through the outer periphery of the end plates 40 and 42 in parallel relation to the external surface of the cylinder 38 so that when the bolts 44 are tightened, the end plates are securely and sealingly connected with the ends of the cylinder 38 thereby forming a cylinder assembly 34 which can be easily assembled and easily disassembled for repair or replacement of parts when necessary. The piston and rod assembly 36 includes a cylindrical piston 46 reciprocal in the cylinder 38 and a piston rod 48 rigidly attached to the piston 46 and which extends through the end plate 42 with the piston rod 48 being reciprocally guided and sealed by a combination rod seal and guide 50.

The cylinder 38 is constructed by fiberglass material and may have any desired internal diameter and length and the glass fiber reinforced material from which the cylinder 38 is constructed is provided with an epoxy lining so that the cylinder is completely non-metallic and resists corrosion due to various corrosive ingredients normally found in natural gas such as $H_2S$ and $CO^2$. The absence of metal in the cylinder facilitates dissipation of heat due to compression and friction. Both end plates 40 and 42 and the piston and rod assembly 36 are provided with a nickel plating utilizing an electrolysis process and cured at a high temperature in order to protect the material from corrosion due to the corrosive properties of the natural gas especially "sour gas".

Figure 5:
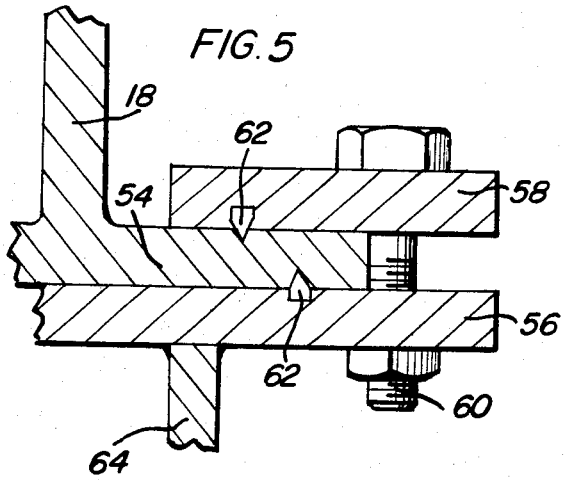
FIG. 5 is a fragmental sectional view illustrating the clamp structure for attaching the cylinder to the beam of the pump jack.

The cylinder assembly 34 is attached to the walking beam 18 by a supporting bracket generally designated by numeral 52 which generally is a clamp engaged with the bottom flange or lip 54 of the beam 18 with the clamp including a bottom plate 56 which extends transversely under beam flange 54 and two top plates 58 interconnected by bolts 60. The plates 56 and 58 have hardened conical inserts 62 projecting from the surface thereof for penetrating partially into the beam lip or flange 54 as illustrated in FIG. 5. This structure prevents the bracket from slipping in relation to the beam 18 when the bracket and piston and cylinder assembly are in angular relation to each other. The plate 56 includes depending lugs 64 receiving a pivot pin or bolt 66 in a bearing support 68 affixed to the upper plate 40 as illustrated in FIG. 2 so that the cylinder assembly 34 may pivot about a transverse axis in relation to the walking beam 18.

The piston rod 48 includes a rod box pin 70 at its lower end that is threaded into and rigidly connected to a bearing 72 connected to a U-shaped bracket 74 by a pivot pin, trunnion or bolt 76. The bracket 74 is connected to the upper end of a depending rod 78 which telescopes into a split tube 80 provided with a supporting plate 82 at its lower end. The split tube 80 is provided with a pair of split clamps 84 including bolt-type fasteners 86 by which the split tube 80 may rigidly clamp the rod 78 thereby effectively varying the support point for the lower end of the piston rod 48 which can pivot about a horizontal axis defined by the pivot pin or bolt 76. The number of clamps may vary depending upon the forces encountered or the length requirements. Also, the support plate 82 is provided with slots 88 receiving fastening bolts 89 extending through a clamp plate assembly 90 for connection with the skid or base 14 thereby facilitating assembly of the plate 82 and the remaining support structure with the skid or base 14 to adapt the unit to any suitable pumping unit or pump jack with the vertical adjustment provided by the clamps 84, split tube 80 and rod 78 providing an adjustment for the head space between the piston and cylinder to increase or decrease efficiency of compression.

The combination rod seal and guide 50 includes a packing gland 91 of generally cylindrical, internally threaded construction rigid with the end plate 42 and concentric with respect to the opening 92 which extends through the plate 42 and receives the piston rod 48. A packing nut 94 is threaded into the gland 91 and is constructed from a plastic material with the nut 94 serving to adjustably compress chevron packing or v-packing 96 in a conventional manner. The packing nut 94 is accurately machined with close tolerances so as to act as a rod guide and rod bearing and may have normal and conventional facilities for receiving lubrication for lubricating the bearing and seals.

The piston 46 includes two peripheral grooves spaced from each other with each groove including a wear ring or band 98. The piston 46 also includes a central groove which receives a pair of seals 99. The seals 99 are conventional and include a tapered edge which faces in the pressure direction so that when the piston is single acting, both tapered edges will face in the same direction whereas when the piston is double-acting, the tapered edges of the seals will face in opposite directions. The wear bands are formed of composite material such as carbon and nylon which have a lubricating property that works well with the fiberglass cylinder 38.

Figure 6:
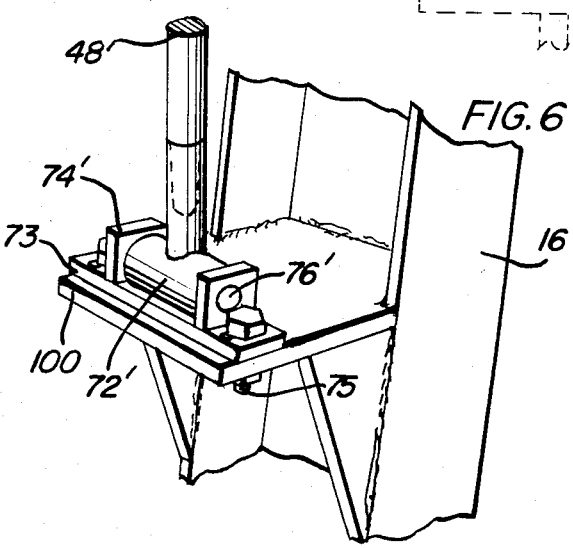
FIG. 6 is a fragmental perspective view illustrating the manner in which the piston rod may be supported from the samson post.

FIG. 6 illustrates a support structure in the form of a platform 100 attached to the samson post 16 at a desired elevation for supporting the bearing 72' with the pin or bolt 76' being supported by lug 74' on slotted plate 73 with bolts 75 through the slots on the plate 73 and through the platform 100 to enable further variation in the installation of the compressor with respect to the pump jack.

Another optional arrangement is the construction of the piston of plastic material instead of metal with the plastic material being resistant to corrosion. Also, the end plates may be constructed of plastic which is resistant to corrosion.

The compressor may be double-acting as illustrated in FIG. 1 in which inlet pipe 102 extends along one side of the cylinder 38 and outlet pipe 104 extends along the outer side thereof with each end of each pipe being communicated with the end of the cylinder through a check valve with the two check valves in the branch pipes leading from pipe 102 admitting gas into the cylinder while the two check valves in the branch pipes connected with the pipe 104 enabling discharge of compressed gas from the cylinder. The lower end of the inlet pipe 102 is connected to a tube or hose 106 extending to a pipe 108 communicated with the wellhead 30 at 110. The discharge or outlet pipe 104 includes a hose or conduit 112 which extends to and is communicated with a sales line (not shown). The double-acting unit operates within the actual movement of the walking beam with the piston coming within a close clearance to both the top and bottom plates during its cycle of movement to provide maximum compression at both ends.

The compressor may also be a single acting unit in which the pump rod weight returning into the well will serve as part of the energy to compress the gas. In the single acting unit, the compressor is in the compression stroke with the rod extended and the piston is at the bottom of the cylinder compressing the gas out of the bottom of the cylinder. While the drawings illustrate the compressor associated with a pump jack in which the samson post is at the center of the beam, the unit can also be incorporated into pump jacks in which the samson post is at the end of the beam remote from the horsehead in either a single or double-acting mode.

Mounting of the upper end of the cylinder to the walking beam has several advantages as compared to attaching the piston rod to the walking beam. The arrangement as disclosed allows the compression stroke to take place on the extension stroke and does not put the piston rod in compression in the single acting unit. Also, by compressing on the extension stroke, there is a reduction in the energy required as the piston rod is in tension with the beam being pulled upwardly at the point of connection to the cylinder and the beam is adapted to be pulled downward during the pump stroke of the downhole pump rather than being pushed up. When the well sucker rods are returning in the well in the single acting unit, the compressor utilizes the weight of the rods and momentum as energy to push the gas from the compressor to the production or sales line. Lubrication of the piston may be obtained by placing a lubricating device through the top plate of the cylinder with a lubricating material injector being operated by the beam. Such lubricators are well known and may be used where it is necessary to help lubricate the piston, piston rod guide and seal. The double-acting unit with appropriate check valves is used to increase the volume of the compressor and, of course, uses the same energy on both the up and down stroke in order to balance the pump jack. The lubrication for the piston may still be at the top of the cylinder and the two piston seals are oriented in opposed relation to each other, that is, with the tapered lip facing in opposite directions. The adjustable supporting structure allows the entire compressor to properly align with the beam with any side loading being relieved by virtue of the various articulate connections and adjustable connections.

Operation of the compressor does not affect the pressures encountered in other equipment such as a separator, heater treater or the like and will increase production from the formation and utilizes the existing pumping unit as its prime mover and energy source in order to increase sealable production. The compressor does not require a liquid dropout or separator system during compression since any liquid vapor will be moved downline along with the gas. The compressor has very few moving parts including the piston and check valves and is constructed to operate in corrosive environments for long periods of time. Also, the compressor is easy to install and the plumbing connections are relatively simple and there are no complex electrical controls or regulators. Further, the compressor may be moved to other pumping units with very little trouble and requires very little maintenance or adjustment with the automatic lubricator serving to lubricate the piston with the action of the beam and the bearings having the same lubrication schedule as the pumping unit.

The compressor may be used on an oil well where the sales lines pressure is sufficiently high so that back pressure restricts fluid and gas production from the formation or on an oil well with a low bottom hole pressure that does not allow gas sales to get into the sales line. Further, the compressor may be used on an oil well where venting gas is necessary in order to produce fluids from the formation; on a lease where gas pressure needs to be boosted in order to operate lease equipment such as separators, natural gas engines and the like; on a gas well being rod pumped in order to remove formation killing fluids where the gas is having to work against a high pressure sales line; as a vapor recovery unit where a pumping well is in the vicinity of a stock tank or tank battery that is being vented to atmosphere with the vented gas being connected to the intake of the compressor; on a marginal well where an increase in production could mean the difference between making a profit or showing a loss and in situations where gas compression is needed in sour gas service.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A compressor adapted to be associated with a pump jack on a producing well with the pump jack including a driven walking beam operating a downhole pump, said compressor comprising an elongated cylinder, a piston reciprocal in said cylinder, a piston rod connected to said piston and extending axially from one end of said cylinder, said cylinder including valved inlet means and valved outlet means for compressible fluid to enable compression thereof, means connecting the upper end of the cylinder to the beam, and means connecting the piston rod to a support structure below the beam whereby oscillation of the beam will compress fluid in the cylinder, said pump jack walking beam having a lower flange, said means connecting the cylinder to the beam including a flange clamp with pointed elements engaged with the flange for securely retaining the clamp in adjusted position on the flange, and a pivotal connection between the clamp and the upper end of the cylinder for relative movement between the beam and cylinder about an axis generally parallel to the axis of pivotal movement of the beam.

2. The compressor as defined in claim 1 wherein said cylinder is constructed of glass fiber reinforced plastic material provided with an epoxy lining on the inner surface.

3. The structure as defined in claim 1 wherein said support structure is the skid base of the pump jack, and means adjustably and pivotally supporting the lower end of the piston rod from the base.

4. The structure as defined in claim 1 wherein said support structure is the samson post which supports the beam, said means supporting the piston rod including a platform rigid with the post and means pivotally connecting the piston rod to the platform.

5. In combination with a pump jack associated with a producing well, said pump jack including a walking beam, means supporting the beam for oscillation about a horizontal transverse axis, means connected to said beam to cause oscillation thereof and means connecting the beam to a sucker rod extending into the well and operatively connected to a downhole pump, a compressor connected to said beam and said supporting means to operate the compressor in response to oscillation of the beam, said compressor including an inlet connected to the producing well for receiving gas from the well and an outlet for compressed gas adapted to be connected to a gas sales line, said compressor comprising an elongated cylinder, means pivotally connecting the upper end of the cylinder to the beam between the axis thereof and the means connected to the beam to cause oscillation, a piston in the cylinder, said piston including a depending piston rod extending through the bottom of the cylinder in sealed relation, means pivotally connecting the lower end of the piston rod to said supporting means in a manner to preclude longitudinal reciprocation, said gas inlet and outlet being valved and communicated with the cylinder for compression of gas when the beam is oscillated to move the cylinder upwardly as the gravitational force of the sucker rod returning to the well assists in compression of the gas with the piston rod being in tension when the cylinder is moved upwardly, said means connecting the piston rod to said supporting means including a generally U-shaped yoke connected to the supporting means with the yoke including upstanding lugs receiving the lower end of the piston rod therebetween and a pivot rod connecting the piston rod and lugs for pivotal movement about a generally horizontal transverse axis.

6. The combination as defined in claim 5 wherein said supporting means includes a skid, an upstanding, telescopically adjustable support member adjustably mounted on said skid, said yoke being mounted at the upper end of the support member to enable adjustment of the point of connection between the piston rod and supporting means both vertically and horizontally.

7. The combination of claim 5 wherein said supporting means includes a samson post, a platform rigidly secured to said post, said yoke being adjustably supported on said platform to enable adjustment of the point of connection between the piston rod and support means.

8. The combination as defined in claim 5 wherein said means connecting the upper end of the cylinder to the beam comprises a clamp, said beam including a transverse bottom flange, said clamp including clamp plates adjustably engaging opposite surfaces of the flange and including pointed projections to bite into the flange, and a transverse pivot rod and lugs interconnecting the upper end of the cylinder and the lower clamp plate.

9. In combination with a pump jack associated with a producing well, said pump jack including a walking beam, means supporting the beam for oscillation about a horizontal transverse axis, means connected to said beam to cause oscillation thereof and means connecting the beam to a sucker rod extending into the well and operatively connected to a downhole pump, a compressor connected to said beam and said supporting means to operate the compressor in response to oscillation of the beam, said compressor including an inlet connected to the producing well for receiving gas from the well and an outlet for compressed gas adapted to be connected to a gas sales line, said compressor comprising an elongated cylinder, means pivotally connecting the upper end of the cylinder to the beam, a piston in the cylinder, said piston including a depending piston rod extending through the bottom of the cylinder in sealed relation, means pivotally connecting the lower end of the piston rod to said supporting means in a manner to preclude longitudinal reciprocation, said gas inlet and outlet being valved and communicated with the cylinder for compression of gas when the beam is oscillated to move the cylinder upwardly as the gravitational force of the sucker rod returning to the well assists in compression of the gas with the piston rod being in tension when the cylinder is moved upwardly, said supporting means including a samson post supporting the walking beam between the compressor and the sucker rod whereby the gravitational forces and kinetic forces exerted on the beam when the sucker rod returns into the well will assist in moving the cylinder upwardly thereby utilizing such forces to assist in compressing the gas, said means connecting the piston rod to said supporting means including a generally U-shaped member having upwardly extending lugs pivotally connected to the piston rod for pivotal movement of the piston rod about the generally horizontal axis transverse to the beam, said means connecting the cylinder to the beam including a beam clamp with depending lugs pivotally connected to the upper end of the cylinder for pivotal movement about a generally horizontal axis transverse to the beam.

* * * * *